US007700538B2

(12) United States Patent
Neal

(10) Patent No.: US 7,700,538 B2
(45) Date of Patent: Apr. 20, 2010

(54) CLEANING COMPOSITION AND METHOD COMPRISING ALUM, VINEGAR AND SLAKE LIME

(76) Inventor: Jin Neal, 6632 Samba Ave., Las Vegas, NV (US) 89139

( * ) Notice: Subject to any disclaimer, the term of this patent is extended or adjusted under 35 U.S.C. 154(b) by 642 days.

(21) Appl. No.: 11/709,523

(22) Filed: Feb. 23, 2007

(65) Prior Publication Data

US 2008/0202563 A1 Aug. 28, 2008

(51) Int. Cl.
*C11D 17/00* (2006.01)

(52) U.S. Cl. ..... 510/218; 510/191; 510/238; 510/276; 510/362; 510/508

(58) Field of Classification Search ..... None
See application file for complete search history.

(56) References Cited

U.S. PATENT DOCUMENTS

2005/0239675 A1* 10/2005 Makansi ..... 510/223

* cited by examiner

*Primary Examiner*—Necholus Ogden, Jr.
(74) *Attorney, Agent, or Firm*—Jeffrey Weiss; Weiss & Moy, P.C.

(57) ABSTRACT

A cleaning composition and method which may be used to clean a variety of household objects. Such objects may include floor surfaces (including carpets), counter surfaces, bathroom surfaces, clothing, and utensils. In one embodiment, the composition consists essentially of water, vinegar, slaked lime, and alum. In another embodiment, the composition consists essentially of vinegar, lime juice, tamarind, slaked lime, and rock alum.

20 Claims, No Drawings

CLEANING COMPOSITION AND METHOD COMPRISING ALUM, VINEGAR AND SLAKE LIME

FIELD OF THE INVENTION

The present invention relates to cleaning compositions and methods for various household uses and, more specifically, to improved cleaning compositions and methods for general purpose, carpet, and cookware applications.

BACKGROUND OF THE INVENTION

Cleaning compositions of various kinds are used in a typical household. These include specialized cleaners for use in cleaning floors; counter surfaces and table tops; bathroom fixtures and surfaces; cookware (including pots, pans and silverware); carpets and the like. A need always exists for more effective compositions and methods for one or more of these cleaning applications.

The present invention satisfies this need and provides other, related, advantages.

SUMMARY OF THE INVENTION

In accordance with one embodiment of the present invention, a cleaning composition is disclosed. The composition consists essentially of: water, vinegar, slaked lime, and alum.

In accordance with another embodiment of the present invention, a cleaning composition is disclosed. The composition consists essentially of: vinegar, lime juice, tamarind, slaked lime, and rock alum.

In accordance with a further embodiment of the present invention, a cleaning method is disclosed. The method comprises: providing a composition consisting essentially of water, vinegar, slaked lime, dishwashing liquid concentrate, and ammonium alum; and dispensing said composition onto an object to be cleaned.

In accordance with a still further embodiment of the present invention, a cleaning method is disclosed. The method comprises: providing a composition consisting essentially of water, vinegar, slaked lime, dishwashing liquid concentrate, and ammonium alum; heating said composition; immersing utensils into said composition; removing said utensils from said composition; and rinsing said utensils.

DETAILED DESCRIPTION OF THE PREFERRED EMBODIMENTS

According to one embodiment of the present invention, a general purpose cleaning composition and method is disclosed. The primary components of such a general purpose cleaning composition may include water, vinegar, slaked lime, dishwashing liquid concentrate (preferably lemon citrus concentrate), and ammonium alum. In a preferred embodiment, a general purpose cleaning composition consistent with the present invention may consist of the following components in the following relative amounts—about 10-15% water, about 75-85% vinegar, about 2-5% slaked lime, about 2-5% concentrated dishwashing liquid, and about 1-3% ammonium alum. The following approximate percentages are considered to be preferred: about 13% water, about 79% vinegar, about 3% slaked lime, about 3% concentrated dishwashing liquid, and about 2% ammonium alum.

Preferably, the components of a composition as set forth above are mixed together, and the resulting composition is dispensed in a misting type of spray on a surface that is to be cleaned. Depending on the object to be cleaned and/or the nature of the stain or the like thereon, it may be desired to permit the solution to remain on the object for a period of time, which may be as long as 30 minutes or even longer, before removing. Typically, removing may be accomplished with a moist cloth or sponge. Depending on the severity of the stain, it may be desired to scrub with a brush or sponge prior to removal.

A composition as described herein has demonstrated, during testing, effectiveness in removing ink, grease, and vehicle fluid stains. It has also been show effective in treating a broad variety of surfaces, including bathroom surfaces (including shower glass and bathtubs), stoves, clothing, and carpeting.

According to another embodiment of the present invention, a carpet and floor cleaning composition and method is disclosed. The primary components of such a cleaning composition may include water, vinegar, white slaked lime, and rock alum. In a preferred embodiment, a carpet and floor cleaning composition consistent with the present invention may consist of the following components in the following relative percentages—about 45-55% vinegar, about 40-50% water; about 1-5% white slaked lime and about 1-5% rock alum. The following approximate percentages are considered to be preferred: about 52% vinegar, about 44% water, about 2% white slaked lime and about 2% rock alum.

Preferably, the components of a composition as set forth above are mixed together, and the resulting composition is dispensed in a misting type of spray on a surface that is to be cleaned. Where the composition has been applied to carpeting, it is desired to vacuum the treated area after treatment. The cleaning composition as herein described has also proven to be effective in cleaning grout. For such application, it is desired to spray the composition on the area to be treated, to scrub the area with a brush, and to then remove the composition with a cloth or sponge.

According to another embodiment of the present invention, a cookware cleaning composition and method is disclosed. The primary components of such a cleaning composition may include vinegar, lime juice, tamarind, slaked lime, and rock alum. In a preferred embodiment, a cookware cleaning composition consistent with the present invention may consist of the following components in the following relative percentages—about 45-55% vinegar, about 25-35% lime juice, about 5-15% tamarind, about 1-8% slaked lime, and about 1-8% rock alum. The following approximate percentages are considered to be preferred: about 52% vinegar, about 32% lime juice, about 8% tamarind, about 4% slaked lime, and about 4% rock alum.

In one embodiment, the above-listed components are mixed together, and the resulting composition/mixture is heated, preferably to a boil. Utensils, including specifically silver utensils, may then be submerged for approximately one minute or longer. Thereafter, the items may be removed and washed with soap and water. Such a method has been shown to restore the shine of utensils.

While the invention has been particularly shown and described with reference to the preferred embodiments thereof, it will be understood by those skilled in the art that the foregoing and other changes in form and details may be made therein without departing from the spirit and scope of the invention.

I claim:

1. A cleaning composition consisting essentially of water, vinegar, slaked lime, and alum.

2. The cleaning composition of claim 1 further consisting of concentrated dishwashing liquid.

3. The cleaning composition of claim 1 wherein the alum is rock alum.

4. The cleaning composition of claim 1 wherein the alum is ammonium alum.

5. The cleaning composition of claim 2 wherein the alum is ammonium alum.

6. The cleaning composition of claim 5 consisting essentially of about 10-15% water, about 75-85% vinegar, about 2-5% slaked lime, about 2-5% concentrated dishwashing liquid, and about 1-3% ammonium alum.

7. The composition of claim 6 consisting essentially of about 13% water, about 79% vinegar, about 3% slaked lime, about 3% concentrated dishwashing liquid, and about 2% ammonium alum.

8. A cleaning composition consisting essentially of vinegar, lime juice, tamarind, slaked lime, and rock alum.

9. The composition of claim 8 consisting essentially of about 45-55% vinegar, about 25-35% lime juice, about 5-15% tamarind, about 1-8% slaked lime, and about 1-8% rock alum.

10. The composition of claim 8 consisting essentially of about 52% vinegar, about 32% lime juice, about 8% tamarind, about 4% slaked lime, and about 4% rock alum.

11. A cleaning method comprising:

providing a composition consisting essentially of water, vinegar, slaked lime, dishwashing liquid concentrate, and ammonium alum; and dispensing said composition onto an object to be cleaned.

12. The cleaning method of claim 11 wherein the composition consists essentially of about 10-15% water, about 75-85% vinegar, about 2-5% slaked lime, about 2-5% concentrated dishwashing liquid, and about 1-3% ammonium alum.

13. The cleaning method of claim 12 wherein the composition consists essentially of about 13% water, about 79% vinegar, about 3% slaked lime, about 3% concentrated dishwashing liquid, and about 2% ammonium alum.

14. The cleaning method of claim 11 wherein said object is a floor surface.

15. The cleaning method of claim 11 wherein said object is a bathroom surface.

16. The cleaning method of claim 11 wherein said object is a counter surface.

17. The cleaning method of claim 11 wherein said object is an article of clothing.

18. A cleaning method comprising:

providing a composition consisting essentially of water, vinegar, slaked lime, dishwashing liquid concentrate, and ammonium alum;

heating said composition;

immersing utensils into said composition;

removing said utensils from said composition; and rinsing said utensils.

19. The method of claim 18 wherein the composition consists essentially of about 45-55% vinegar, about 25-35% lime juice, about 5-15% tamarind, about 1-8% slaked lime, and about 1-8% rock alum.

20. The method of claim 19 wherein the composition consists essentially of about 52% vinegar, about 32% lime juice, about 8% tamarind, about 4% slaked lime, and about 4% rock alum.

* * * * *